US006109558A

United States Patent [19]

Mayer

[11] Patent Number: 6,109,558

[45] Date of Patent: Aug. 29, 2000

[54] YARN WINDING APPARATUS AND METHOD

[75] Inventor: Manfred Mayer, Remscheid, Germany

[73] Assignee: Barmag AG, Remscheid, Germany

[21] Appl. No.: 09/168,825

[22] Filed: Oct. 8, 1998

[30] Foreign Application Priority Data

Oct. 10, 1997 [DE] Germany ..... 197 44 824

[51] Int. Cl.[7] ..... B65H 54/28

[52] U.S. Cl. ..... 242/481.7

[58] Field of Search ..... 242/481.7, 481.6

[56] References Cited

U.S. PATENT DOCUMENTS

| | | | |
|---|---|---|---|
| 3,650,486 | 3/1972 | Hasegawa et al. | 242/481.7 |
| 4,505,437 | 3/1985 | Schippers et al. | 242/481.7 |
| 4,561,603 | 12/1985 | Schippers et al. | 242/481.7 |
| 4,789,112 | 12/1988 | Schippers et al. . | |
| 4,867,386 | 9/1989 | Schroff et al. | 242/481.7 |
| 5,029,762 | 7/1991 | Behrens et al. | 242/481.7 |
| 5,624,081 | 4/1997 | Turk et al. . | |

*Primary Examiner*—John M. Jillions
*Attorney, Agent, or Firm*—Alston & Bird LLP

[57] ABSTRACT

A yarn traversing apparatus for reciprocating a running yarn to form a wound yarn package, and wherein the yarn is reciprocated by sequential contact with oppositely rotating rotator blades. The blades can each be driven at a variable rotational speed, so that irrespective of the position of the yarn radially along the length of the rotator blades, the traversing speed of the yarn can be controlled so as to follow a predetermined traversing speed profile, which may be constant or variable.

17 Claims, 4 Drawing Sheets

YARN WINDING APPARATUS AND METHOD

BACKGROUND OF THE INVENTION

The present invention relates to a yarn winding machine for winding a plurality of continuously advancing yarns into yarn packages.

A yarn winding machine is disclosed in EP 0 374 536 and corresponding U.S. Pat. No. 5,029,762, wherein the yarn is reciprocated by means of a rotary blade type traversing apparatus along a guide bar with a guide edge. The rotary blade type traversing apparatus comprises oppositely driven rotary blades which are each mounted on a rotor. During its reciprocating movement, the yarn is alternatingly guided by one rotary blade from one end of the traverse stroke to the opposite end thereof. At the end of the traverse stroke, the guiding blade moves below the guide bar, while the oppositely driven blade receives the yarn and guides same to the opposite end of the traverse stroke. While being traversed by the rotary blade, the yarn slides radially along a pushing edge of the rotary blade, so that a constant angular velocity of the rotary blade results in a constantly changing trajectory speed of the yarn and, thus, in a constantly changing traversing speed. This is corrected by the guide bar, which has a curved guiding edge such that while being traversed, the yarn does not essentially change its radial position on the guiding blade.

The above process involves the problem of having to deflect the yarn considerably from the traversing plane. This transverse deflection of the yarn is realized by a corresponding looping on the guide bar, which leads again to friction differences on the yarn and, thus, to fluctuations in the yarn tension. Long traverse strokes of, for example, 250 mm, necessitate a relatively large transverse movement of the yarn, which results again in an unsteady advance of the yarn.

It is therefore the object of the invention to provide an improved winding machine and a method of the described type, such that it becomes possible to deposit the yarn on the package as gently as possible. A further object of the invention is to provide a yarn winding machine which permits winding of packages with a flexible buildup and a simple control of the mass distribution on the package.

SUMMARY OF THE INVENTION

The above and other objects and advantages of the invention are achieved by the provision of a yarn traversing apparatus which comprises a guide bar having a guide edge which extends generally in the direction of the yarn traverse, and a pair of rotary blades which are rotatably mounted so that the outer extremities of the blades move along the guide edge. A drive is provided for rotatably driving each of the rotary blades in opposite directions such that one of the blades moves the running yarn along the guide edge and toward one end thereof and the other of the blades moves the running yarn along the guide edge toward the other end thereof. Also, a control system is provided for variably controlling the rotational speed of each of the rotary blades so that the yarn may be guided along the guide edge of the guide bar by each of the rotary blades in a predetermined traversing speed profile.

The invention is characterized by the fact that despite a change in position of the yarn with respect to the rotary blade, the yarn can be guided by the rotary blade within a traverse stroke at a predetermined traversing speed. To move the yarn at a constant traversing speed within the traverse stroke, the angular velocity of the rotary blade that guides the yarn, is controlled such that the yarn can be guided at a constant trajectory speed. Thus, the invention offers the advantage of not having to maintain the position of the yarn on the guiding blade constant, i.e. at a decisive guiding radius. Consequently, the traversing speed is no longer determined by the shape of the guide bar. The guiding edge of the guide bar is not restricted in its design within the traverse stroke, and it may, for example, be selected such as to obtain favorable yarn tensions during the winding as well as a favorable package build.

In a particularly advantageous further development of the invention, the guiding edge of the guide bar is made straight, so that while being guided, the yarn is not required to perform a deflection. It is also possible to arrange the guiding edge such that the yarn exhibits a minimal looping about the guide bar. In the extreme case, the guiding edge of the guide bar may extend in the traversing plane, which is the plane of the yarn advance without transverse deflection. The looping of the yarn about the guide bar remains substantially constant while the yarn is being traversed. This allows uniform yarn tensions to be achieved during the winding of the yarn.

In a preferred variant of the winding machine, the rotors of the rotary blades are driven such that the yarn is guided by the rotary blade along the guiding edge of the guide bar at a variable traversing speed. Since the mass distribution of the yarn on the package is dependent on the respectively adjusted traversing speed, this variant has the advantage that it is possible to adjust a desired profile of the traversing speed within the traverse stroke. This allows cylindrical packages to be wound with a uniform package surface. Furthermore, the packages exhibit a uniform hardness over the entire package surface.

In a particularly advantageous embodiment, the control system is programmed such that the rotational speed of each of the rotary blades is varied as a function of the angular position of the associated rotary blade as the associated rotary blade guides the yarn along the guide edge of the guide bar. The yarn may thus be guided with a great accuracy over the entire traverse stroke, and with no undefined yarn deposits on the packages. Between the rotary blades, the yarn is transferred always in the same place. As a result, an advantageous straight package edge is formed.

However, it is also possible to change the points of the yarn transfer in the stroke end regions. This allows the traverse stroke to be changed periodically or even in a manner controlled by a predetermined time function. In such a variant of the winding machine, the angular velocity of the blades is controlled as a function of the length of the traverse stroke. Thus, for example, in the case of a shortened traverse stroke, the angular speed of the rotary blade that does not guide the yarn is increased such that despite a greater trajectory length, the blade meets the yarn guiding blade in the reversal region of the yarn.

The angular velocity of the rotary blades can be varied in a particularly advantageous manner, in that the rotor which mounts the blades, is driven by a controllable electric motor. The use of a stepping motor has in addition the advantage that each position of the rotary blade can be accurately controlled by the electric motor. The traverse stroke which is defined by a sector angle being covered by the rotary blade, can be exactly maintained by the step sequence of the stepping motor.

The control system may include a pair of sensors for respectively detecting the position of the oppositely rotating rotary blades. The electric motors may then be controlled by signals from the sensors indicating the positions of the rotating rotary blades. Thus, a constant feedback exists between the position of the rotary blades and the setting of electric motor. In addition, the control system ensures that the yarn transfers may be carried out in the stroke reversal regions of the traverse stroke without a missing guidance of the yarn.

The yarn winding machine typically comprises a winding spindle for mounting a plurality of bobbin tubes in a coaxial arrangement, and so as to define side-by-side winding positions. In such case, the rotary blades of the adjacent traversing mechanisms can each be driven by a separate electric motor. This provides the special advantage that the package build may be different in each winding position. This can be important in minimizing the vibration of the winding spindle, which can become critical at high winding speeds. A reason among others is the inherently critical frequency of the winding spindle, which can not be damped as a practical matter. Frequently, the vibrations are induced by ribbons or ribbonlike winding conditions which may simultaneously occur on all packages and cause the spindle to vibrate. However, the winding machine of this embodiment has the advantage that these ribbons or ribbonlike winding conditions occur on the individual winding positions at staggered times, which will then lead to a lesser excitation of the winding spindle.

The method of the present invention is characterized in particular in that the yarn can be deposited on the package surface at the desired guiding speed. This allows the mass distribution of the yarn on the package surface to be controlled. On the other hand, the laws of motion for forming a cylindrical package with straight edges can be optimized such that so-called sloughs from the package edges are absent.

The method of the invention is especially advantageous so as to be able to wind the packages driven by one winding spindle over a larger speed range. Moreover, the method of the present invention has the advantage that each package may be wound with a different build. For example, when winding dyed yarns, each yarn has, depending on its color, different winding characteristics. These different characteristics can be compensated for, according to the present invention, by individually controlling the traversing motion of the rotary blades, so that qualitatively identical packages can be wound in each winding position.

BRIEF DESCRIPTION OF THE DRAWINGS

In the following, embodiments of the yarn winding machine in accordance with the invention are described in more detail with reference to the attached drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
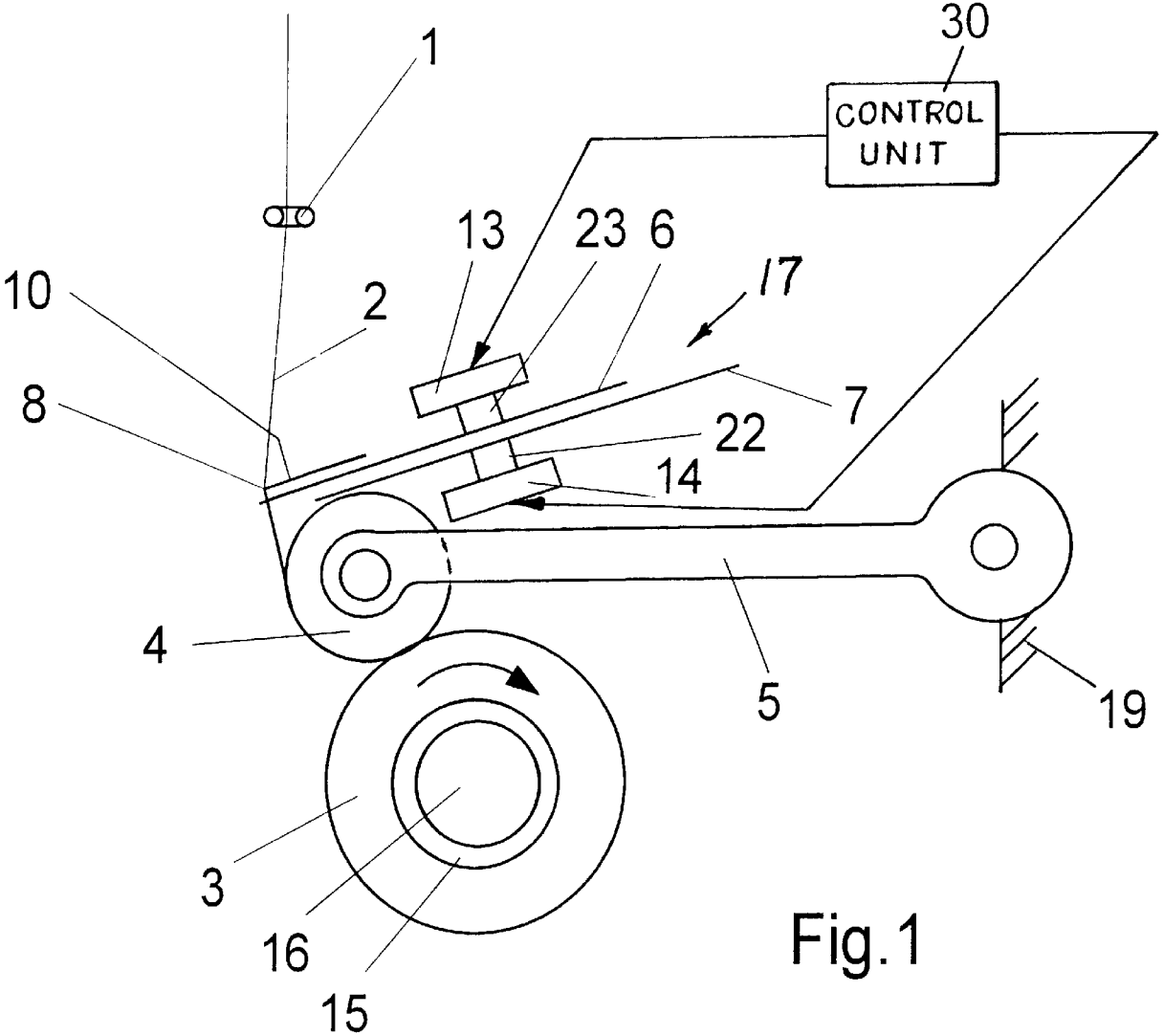
FIG. 1 is a schematic side view of a winding position of a yarn winding machine in accordance with the invention.

FIG. 1 shows a side view of a winding position of a yarn winding machine. In this embodiment, a yarn 2 enters into the winding position of the winding machine. Initially, the yarn advances via a yarn guide 1 to a rotary blade type traversing mechanism 17, which comprises two rotors 22 and 23. The rotor 22 mounts a rotary blade 7 and the rotor 23 mounts a rotary blade 6. The rotor 22 is driven by means of an electric motor 14, and the rotor 23 is driven by an electric motor 13. The rotors are driven in opposite directions, so that the rotary blades move in two substantially parallel planes. The rotors 22 and 23 with their drives face each other.

In a plane parallel to the rotary blades 6 and 7, a guide bar 10 is arranged. The guide bar 10 has a guiding edge 8 which is contacted by the yarn 2. Downstream of the rotary blade type traversing mechanism 17, a contact roll 4 is mounted for rotation on a rocker arm 5 arranged in machine frame 19. The contact roll 4 lies with a predetermined contact force against the surface of a package 3. The package 3 is wound on a tube 15, which is mounted on a winding spindle 16. The winding spindle 16 is driven by means of a spindle motor (not shown) in direction of the arrow. The rotational speed of the spindle is controlled such that the circumferential speed of the package remains constant during the winding. To this end, the rotational speed of the contact roll is monitored as is known in the art.

In the illustrated winding machine, the yarn 2 advances without interruption at a constant speed to the winding position of the winding machine. Initially, the yarn 2 advances through yarn guide 1, which forms the apex of a traversing triangle. Thereafter, the yarn reaches rotary blade type traversing mechanism 17. The rotary blades 6 and 7 which are driven by rotors 22 and 23 rotate in different directions such that the yarn 2 is guided on the guiding edge 8 of guide bar 10. In this process, the one rotary blade assumes guidance in one direction and then moves below the guide bar 10, while the other rotary blade assumes guidance in the other direction and then moves below the guide bar 10. Downstream of the rotary blade type traversing mechanism, the yarn is deflected on the contact roll 4 by more than 90° and subsequently wound on the package 3.

In the described winding machine, the rotary blades 6 and 7 are driven at different angular velocities by means of electric motors 13 and 14. In this process, the electric motors 13 and 14 are controlled by a control unit 30 such that the angular velocity of the rotary blade that guides the yarn is increased, while the rotary blade guides the yarn toward the center of the traverse stroke. After passing the stroke center, the angular velocity of the rotary blade is constantly decreased until same reaches the end of the traverse stroke. This control of the electric motor causes a certain traversing speed to be maintained despite the position change of the yarn on the rotary blades. The traversing speed may be constant within the traverse stroke or, however, it may also be increased or decreased for influencing the package build.

Figure 2:
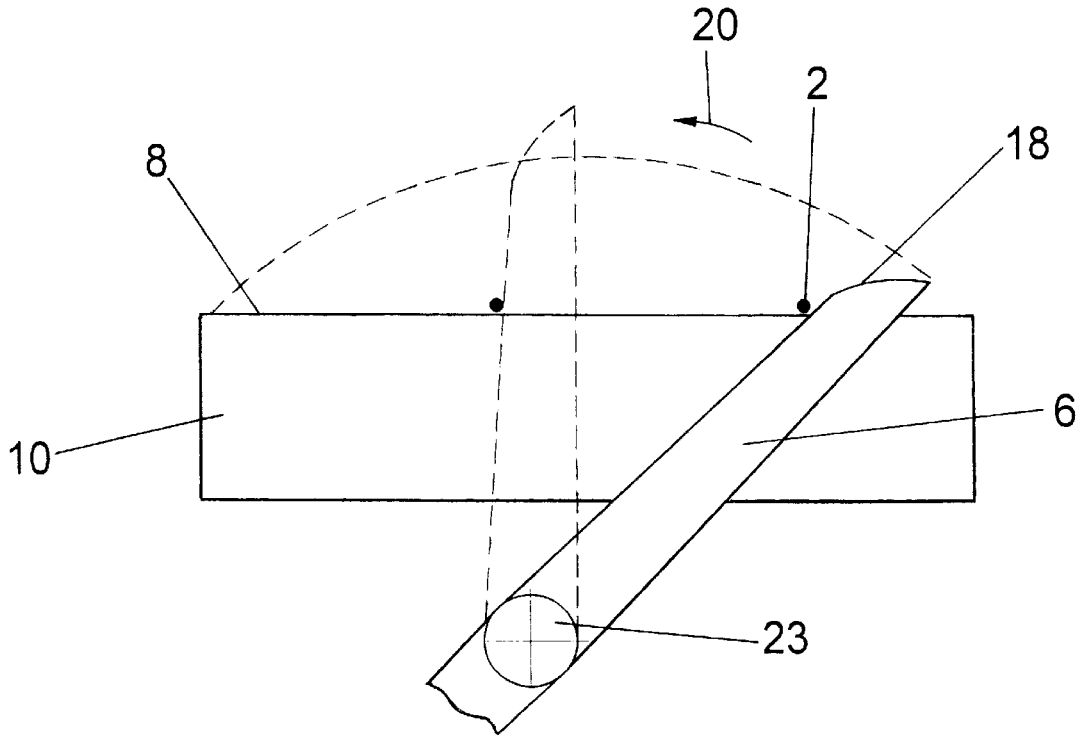
FIG. 2 is a schematic top view of the rotary blade type traversing apparatus of FIG. 1.

FIG. 2 is a schematic top view of a rotary blade type traversing mechanism. In this illustration, the rotary blade 6 receives the yarn 2 at the end of the traverse stroke. The yarn 2 contacts a pushing edge 18 of rotary blade 6 and the guiding edge 8 of guide bar 10. When the rotary blade 6 is further rotated by rotor 23 in the direction of rotation 20, the yarn will slide along the guiding edge 8 of the guide bar. At the same time, a relative movement occurs between the yarn 2 and the pushing edge 18 of rotary blade 6. By the rotation of rotary blade 6, the lever arm engaging yarn 2 changes. The rotary blade 6 is now driven at a constantly increasing angular velocity. This allows to compensate for the change in the trajectory speed of the yarn, which is caused by the change of the lever arm. The yarn 2 is guided at a predetermined traversing speed along the guiding edge 8. The traversing speed is controlled solely by the angular velocity of the rotary blade. Thus, the traversing speed of the yarn is independent of the position of the yarn on rotary blade 6.

Figure 3:
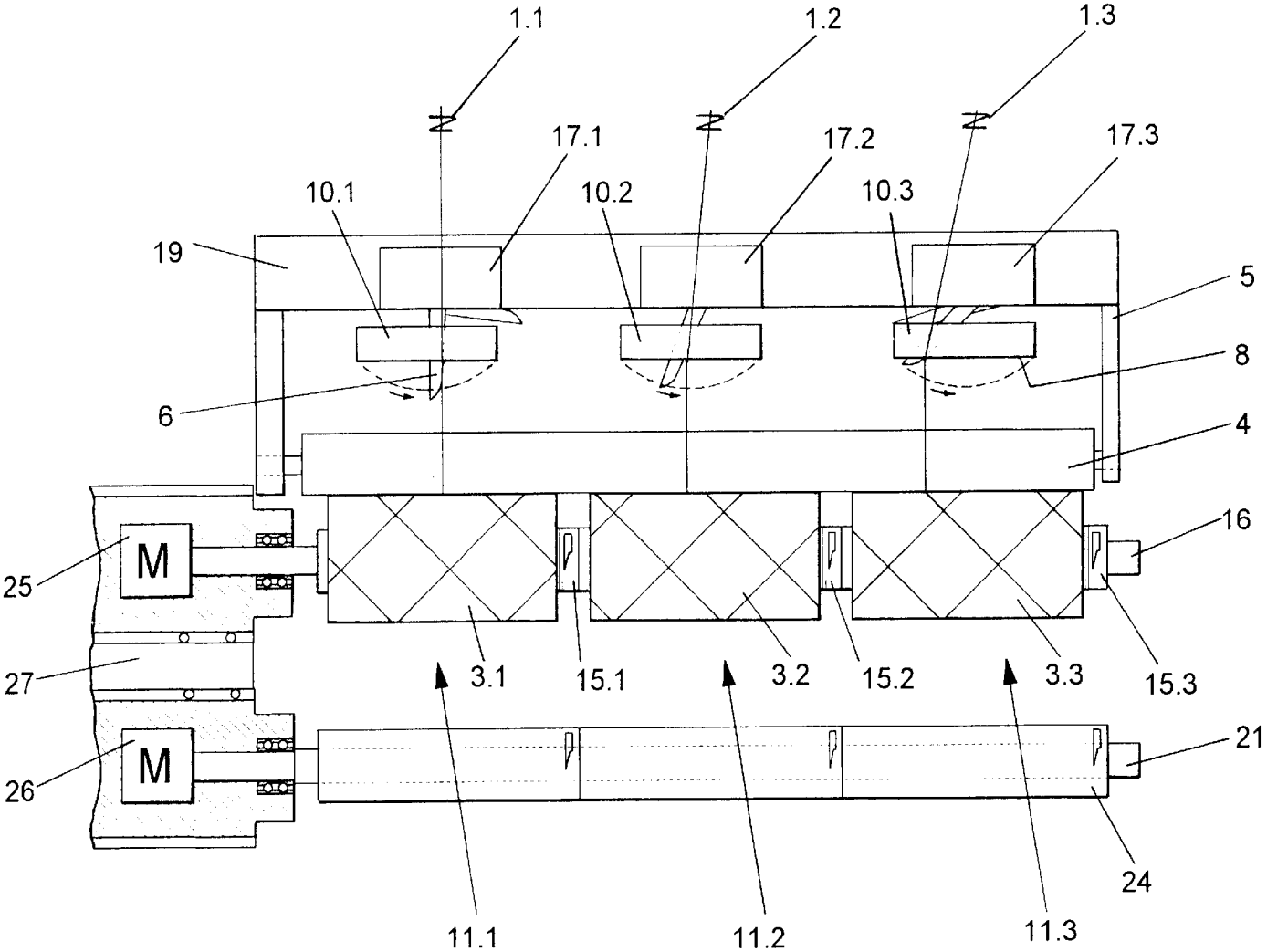
FIG. 3 is a schematic front view of a winding machine.

FIG. 3 is a front view of a particular winding machine in accordance with the invention. The winding machine has three side-by-side winding positions 11.1, 11.2, and 11.3. Each winding position accommodates a rotary blade type traversing mechanism 17.1, 17.2, and 17.3. The rotary blade type traversing mechanisms are of the same construction as previously described with reference to FIG. 1. For purposes of simplification, the mounting rotors and the electric motors are not shown in FIG. 3. The rotary blade type traversing mechanisms 17.1, 17.2, and 17.3 are driven independently of one another, each by means of two electric motors.

Downstream of the rotary blade type traversing mechanism, the contact roll 4 is mounted for rotation about a rocker arm 5 in machine frame 19. In this embodiment, the contact roll extends over the entire length of the winding machine, and lies in each of the winding positions against the surface of each of the packages 3.1, 3.2, and 3.3 that are wound in each winding position. The package 3.1 is wound on a tube 15.1, the package 3.2 on a tube 15.2, and package 3.3 on a tube 15.3. The tubes 15.1, 15.2, and 15.3 are mounted one after the other on a winding spindle 16. The winding spindle 16 is supported in cantilever fashion in a spindle turret 27. The spindle turret 27 mounts a spindle motor 25 in the axis of winding spindle 16, and is connected to same.

The spindle turret 27 supports in cantilever fashion a second winding spindle 21 that extends therefrom off center 180° out of phase. The winding spindle 21 connects to spindle motor 26, and mounts empty tubes 24.

In the embodiment of the winding machine as shown in FIG. 3, the winding spindle 16 is in its operating position. Each of the winding positions is simultaneously driven by the winding spindle for winding the packages. In the individual winding positions 11.1, 11.2, and 11.3, the rotary blade type traversing mechanisms 17.1, 17.2, and 17.3 are driven independently of one another, so that the guidance of the yarn differs in each winding position. Thus, for example, the rotary blades of adjacent winding positions which rotate in the same direction may be controlled so as to be driven asynchronously relative to each other. This is illustrated in FIG. 3, which shows the rotary blade 6 in winding position 11.1 in the center of the traverse stroke, the rotary blade 6 in winding position 11.3 in the initial range of the traverse stroke, and the rotary blade 6 in the winding position 11.2 at a midpoint compared to the other two blades. As a result of this method of winding yarns in several winding positions, the package build differs in each winding position, and the packages are not produced synchronously. This method is therefore advantageous to reduce the vibrations of the winding spindle.

After the packages 3.1, 3.2, and 3.3 are fully wound, the winding spindles 16 and 21 are rotated by spindle turret 27 such that the winding spindle 21 with empty tubes 24 enters into the path of the yarn. The sequence of motion is described in EP 0 374 536 and corresponding U.S. Pat. No. 5,029,762, which are herewith incorporated by reference.

In the winding machine shown in FIG. 3, however, it is possible to drive the rotary blade type traversing mechanisms 17.1, 17.2, and 17.3 jointly via two electric motors. To this end, the rotors or rotary blades rotating in the same direction are driven by means of one motor. In an operation of this kind, an identical package is wound in each winding position.

Figure 4:
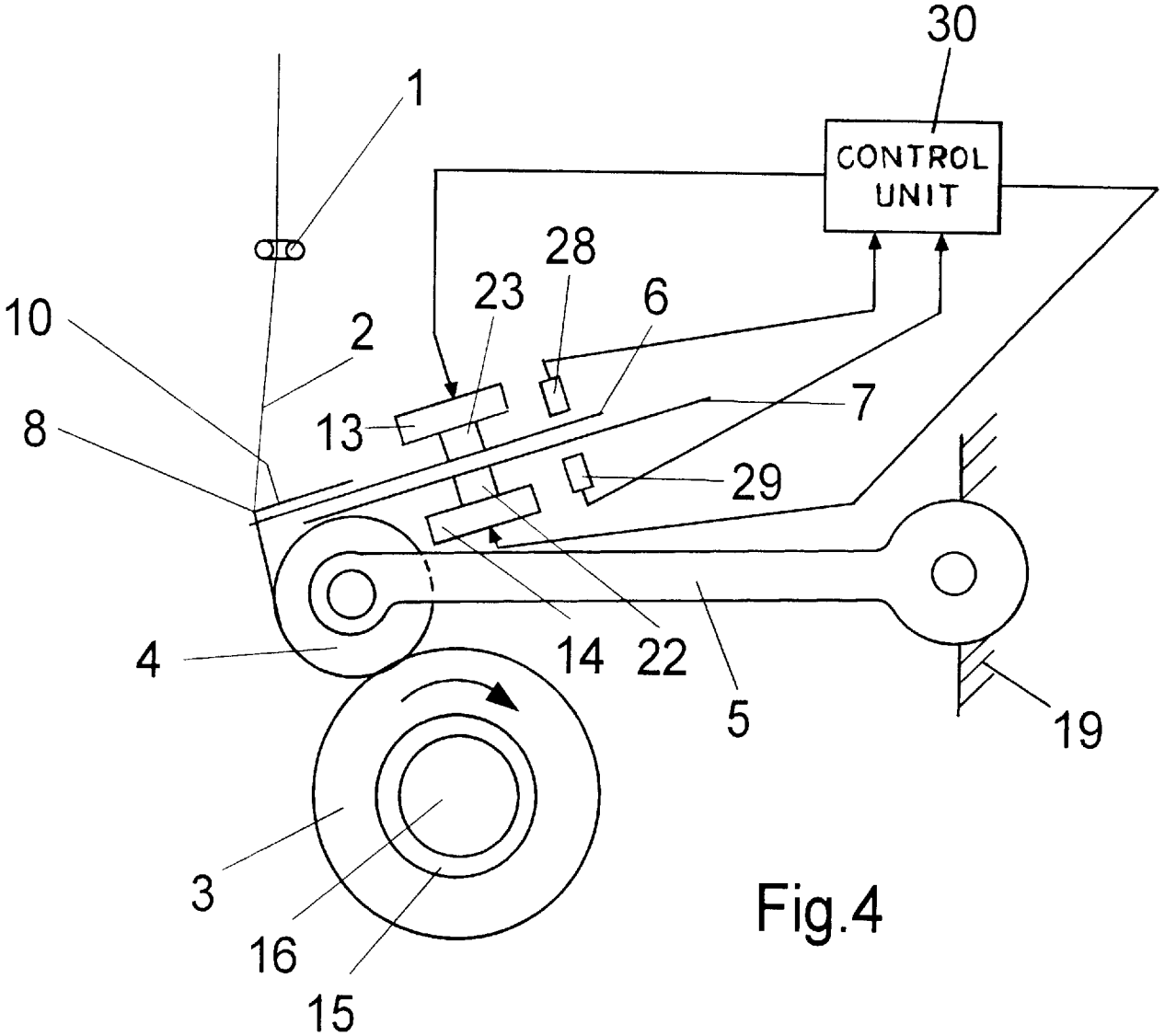
FIG. 4 is a schematic side view of a further embodiment of a winding position.

FIG. 4 shows a further embodiment of a winding position as may be used in a winding machine of FIG. 3. In FIG. 4, components having the same function are identified by the same numerals as in the winding position of FIG. 1, the description of which is herewith incorporated by reference. The winding position of FIG. 4 comprises a sensor 28, which detects the angular position of the rotary blades 6. The angular position of rotary blades 7 is measured via a sensor 29. The sensors 28 and 29 are connected to a control unit 30. The control unit 30 is connected to electric motors 13 and 14 for controlling same. In this setup, the electric motors are controlled in accordance with the actual position of the associated rotary blade. The electric motors may be constructed as servomotors.

In the case of the winding positions described with reference to FIGS. 1 and 3, the electric motors may be stepping motors. Due to a high number of paired poles, for example, 50 poles, it is possible to adjust very accurately the desired position of the rotary blades and, thus, the traversing speed of the yarn within the traverse stroke.

In this connection, it should expressly be mentioned that the winding machine also covers such rotary blade type traversing mechanisms, which reciprocate the yarn over a traverse stroke by means of a plurality of juxtaposed rotary blades arranged side by side.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A yarn traversing apparatus for reciprocating a running yarn transversely to its running direction over a predetermined traverse stroke, comprising a guide bar having a guide edge which extends generally in the direction of the yarn traverse, a pair of rotary blades, a pair of rotors rotatably mounting respective ones of the rotary blades so that the outer extremities of the blades move along the guide edge, drive means for rotatably driving each of the rotary blades in opposite direction such that one of said blades moves the running yarn along the guide edge and toward one end thereof and the other of said blades moves the running yarn along the guide edge toward the other end thereof, and a control system for variably and separately controlling the rotational speed of each of the rotary blades so that the yarn may be guided along the guide edge of the guide bar by each of said rotary blades in a predetermined traversing speed profile.

2. The yarn traversing apparatus as defined in claim 1 wherein the guide edge of the guide bar is straight.

3. The yarn traversing apparatus as defined in claim 1 wherein the control system is programmed such that the yarn is guided by at least one of the rotary blades along the guide edge of the guide bar at a variable traversing speed.

4. The yarn traversing apparatus as defined in claim 1 wherein the control system is programmed such that the rotational speed of each of the rotary blades is varied as a function of the angular position of the associated rotary blade as the associated rotary blade guides the yarn along the guide edge of the guide bar.

5. The yarn traversing apparatus as defined in claim 1 wherein the control system is programmed such that the rotational speed of each of the rotary blades is controlled as a function of the length of the traverse stroke in such a manner that the oppositely rotating rotary blades always meet at a reversal region where the yarn is transferred from one rotary blade to the other.

6. The yarn traversing apparatus as defined in claim 1 wherein said drive means comprises a separate electric motor for each of said rotary blades, and wherein said control system separately controls each of the electric motors.

7. The yarn traversing apparatus as defined in claim 6 wherein the electric motors are stepping motors.

8. The yarn traversing apparatus as defined in claim 6 wherein the control system includes a pair of sensors for respectively detecting the position of the oppositely rotating rotary blades, and wherein the electric motors are controlled by signals from the sensors indicating the positions of the rotating rotary blades.

9. A yarn winding apparatus for winding a plurality of running yarns to form a corresponding number of yarn packages, comprising a winding spindle for mounting a plurality of bobbin tubes in a coaxial arrangement, a yarn traversing mechanism for reciprocating each of the running yarns along respective traverse strokes and so as to form a wound yarn package on each of the bobbin tubes, and wherein each of the traversing mechanisms comprises (a) a guide bar having a guide edge which extends generally in the direction of the yarn traverse, (b) a pair of rotary blades, (c) a pair of rotors rotatably mounting respective ones of the rotary blades so that the outer extremities of the blades move along the guide edge, (d) drive means for rotatably driving each of the rotary blades in opposite direction such that one of said blades moves the running yarn along the guide edge and toward one end thereof and the other of said blades moves the running yarn along the guide edge toward the other end thereof, and (e) a control system for variably and separately controlling the rotational speed of each of the rotary blades so that the yarn may be guided along the guide edge of the guide bar by each of said rotary blades in a predetermined traversing speed profile.

10. The yarn winding apparatus as defined in claim 9 wherein the drive means for the rotary blades of adjacent traversing mechanisms which rotate in the same direction comprise a common electric motor.

11. The yarn winding apparatus as defined in claim 9 wherein the drive means for the rotary blades of all of the traversing mechanisms comprise a separate electric motor for each rotary blade.

12. The yarn winding apparatus as defined in claim 9 wherein the control system for each traversing mechanism acts to control the rotation of the rotary blades such that the rotary blades of adjacent traversing mechanisms which rotate in the same direction are driven asynchronously relative to each other.

13. A method of winding a running yarn onto a rotating bobbin tube to form a yarn package, and comprising the steps of reciprocating the running yarn transversely to its running direction over a predetermined traverse stroke, and including sequentially contacting the running yarn with each of a pair of oppositely rotating rotary blades such that one of the rotary blades moves the running yarn along the traverse stroke toward one end thereof and the other of the rotary blades moves the running yarn along the traverse stroke toward the other end of the traverse stroke, and variably and separately controlling the rotational speed of each of the rotary blades so that the yarn is moved along the traverse stroke in a predetermined traversing speed profile.

14. The method as defined in claim 13 comprising the further step of guiding the running yarn so as to cause it to move radially with respect to each of the rotary blades as each rotary blade moves the running yarn along the traverse stroke.

15. The method as defined in claim 14 wherein the controlling step includes varying the rotational speed of the rotary blades such that the yarn is moved at a substantially constant traversing speed regardless of the radial movement of the running yarn with respect to the rotary blades.

16. The method as defined in claim 13 wherein the controlling step includes controlling the rotational speed of the rotary blades such that the yarn is moved at a variable speed within each traverse stroke.

17. A method for winding a plurality of running yarns to form a corresponding number of yarn packages, comprising the steps of mounting a plurality of bobbin tubes in a coaxial arrangement on a winding spindle to define adjacent winding positions, reciprocating each of the running yarns along respective traverse strokes at each of the winding positions and so as to form a wound yarn package on each of the bobbin tubes, and including sequentially contacting each running yarn with each of a pair of oppositely rotating rotary blades such that one of the rotary blades moves the running yarn along the traverse stroke toward one end thereof and the other of the rotary blades moves the running yarn along the traverse stroke toward the other end of the traverse stroke, and controlling the rotation of the rotary blades such that the rotary blades of adjacent winding positions which rotate in the same direction are driven asynchronously relative to each other.

* * * * *